US006523194B2

(12) United States Patent
Smith

(10) Patent No.: US 6,523,194 B2
(45) Date of Patent: Feb. 25, 2003

(54) KNEE WALL BED

(76) Inventor: Keith B. Smith, P.O. Box 213, Huntsville, UT (US) 84317

( * ) Notice: Subject to any disclaimer, the term of this patent is extended or adjusted under 35 U.S.C. 154(b) by 0 days.

(21) Appl. No.: 09/883,057

(22) Filed: Jun. 18, 2001

(65) Prior Publication Data

US 2002/0189013 A1 Dec. 19, 2002

(51) Int. Cl.[7] ..... A47C 17/48; A47C 19/12
(52) U.S. Cl. ..... 5/10.1; 5/6; 5/147; 52/29
(58) Field of Search ..... 5/1, 3, 4, 5, 6, 5/7, 10.1, 10.2, 138, 146, 147, 174, 177; 52/27, 29; 296/170, 169, 172

(56) References Cited

U.S. PATENT DOCUMENTS

| | | | | | |
|---|---|---|---|---|---|
| 371,871 | A | * | 10/1887 | Ayres | 5/147 |
| 408,171 | A | * | 7/1889 | Gill | 5/147 |
| 584,101 | A | * | 6/1897 | Welch | 5/158 |
| 599,380 | A | * | 2/1898 | Brandish | 5/147 |
| 637,670 | A | * | 11/1899 | Sanor | 5/147 |
| 1,097,903 | A | * | 5/1914 | Barnum | 5/147 |
| 1,205,316 | A | * | 11/1916 | Barnum | 5/147 |
| 1,383,485 | A | * | 7/1921 | Richardson | 5/7 X |
| 1,527,919 | A | * | 2/1925 | Robb et al. | 5/146 |
| 1,579,115 | A | | 3/1926 | Kebbe | 5/1 |
| 1,990,959 | A | * | 2/1935 | Saperstein | 5/155 |
| 2,396,550 | A | | 3/1946 | Awiszus | 5/1 |
| 2,470,930 | A | * | 5/1949 | Jasinski | 5/6 X |
| 2,484,377 | A | * | 10/1949 | Eramo et al. | 5/158 |
| 2,544,762 | A | * | 3/1951 | Lochridge | 5/6 |
| 2,605,480 | A | * | 8/1952 | Miesner | 5/6 |
| 2,628,371 | A | * | 2/1953 | Null | 5/147 |
| 2,645,787 | A | | 7/1953 | Will | 5/10.2 |
| 2,788,528 | A | * | 4/1957 | Hansen | 5/6 |
| 3,517,397 | A | * | 6/1970 | Moore | 5/147 |
| 3,665,527 | A | | 5/1972 | Gonzales | 5/10.2 |
| 3,703,735 | A | * | 11/1972 | Moore | 5/147 |
| 3,729,753 | A | | 5/1973 | Johnson et al. | 5/2.1 |
| 3,852,837 | A | * | 12/1974 | Eakins | 5/147 |
| 4,466,147 | A | * | 8/1984 | Yokoi et al. | 5/155 |
| 4,534,076 | A | * | 8/1985 | Barge | 5/147 |
| 4,631,764 | A | * | 12/1986 | Moskowitz | 5/150.1 |
| 4,853,989 | A | * | 8/1989 | Garcia | 5/10.2 |
| 5,461,735 | A | | 10/1995 | Danton | 5/10.2 |
| 6,425,151 | B2 | * | 7/2002 | Barnett | 5/138 X |

FOREIGN PATENT DOCUMENTS

| | | | | |
|---|---|---|---|---|
| GB | 631435 | * | 1/1949 | 5/146 |
| GB | 2127683 A | * | 4/1984 | 5/6 |

* cited by examiner

*Primary Examiner*—Robert G. Santos
(74) *Attorney, Agent, or Firm*—Wm. Randall May

(57) ABSTRACT

A collapsible and retractable bed structure having design features which permits the bed structure to be folded or collapsed in a manner so as to allow the device to be incorporated into the limited space created between the rafters of a steeply sloping roofline and an interior wall, such as a knee wall, of a home or other building structure. The invention can be used to transform previously unusable or wasted space within a home or other building structure into fully functional living quarters.

9 Claims, 5 Drawing Sheets

KNEE WALL BED

BACKGROUND OF THE INVENTION

This invention relates generally to bedding structures and, more particularly, to a collapsible and retractable bed structure for use in living areas, or potential living areas, where wall space and floor space may be limited or restricted. More specifically, this invention relates to a collapsible bed structure having design features which allow the structure to be installed, retracted and stored within the restricted wall space commonly referred to in the building industry as a "knee wall." The term "knee wall" refers to a short vertical interior wall typically built beneath roof rafters. Knee walls are used to create usable wall space in areas of a home or building structure where the roof pitch will allow for only limited interior wall construction and headspace. Knee walls may or may not be load bearing and are typically framed with 2"×4" wooden wall studs. These walls are usually built 4 feet high in order to limit encroachment of the wall into the usable floor space and so that the walls can be covered with full sheets of 4'×8' drywall sheathing material.

Areas such as lofts, attics, and other areas within a building structure where floor space and vertical wall space are limited by the pitch of the roofline are typically converted into storage space by building owners or tenants or are simply not used at all. Many of these areas could be easily converted into usable living space; however, the limited wall and floor space of these areas greatly inhibits the ability to comfortably place needed living space items such as beds and other furniture within the available room space.

The use of collapsible or foldable type bed structures is known in the prior art. Known prior art devices, such as those disclosed in applicant's information disclosure statement submitted herewith, include beds or cots which can be retracted and stored in the ceiling areas of small-sized rooms such as those found in railroad cars, ship's cabins or hotel rooms. Other prior art devices include a folding bed structure which is hidden within a box simulating a fireplace; a roll-out bed which can be stored out of sight beneath a wall mantle; and a combination bed and lounge having a foldable mattress, the head section of which is retained in a chamber behind an upright wall of a housing unit. While these prior art devices may fulfill their respective particular objectives, there is no disclosure or teaching of a collapsible and retractable bed structure capable of being collapsed and stored within the limited space contemplated by the present invention.

The present invention is a substantial modification and improvement over known prior art designs. The design and construction of the present invention incorporates features which allow the invention to be folded or collapsed into the restricted area between the rafters of a steeply pitched roofline and an interior wall constructed adjacent thereto thereby transforming previously unusable or wasted space into inhabitable and useful living space.

SUMMARY OF THE INVENTION

In view of the foregoing, it is a primary object of this invention to provide a collapsible and retractable bed structure having design features which allow the bed structure to be foldably incorporated into the limited space created between a steeply sloping roofline and an interior wall, such as a knee wall, of a building.

According to an embodiment of the invention, a foldable knee wall bed comprises a collapsible bed frame slidably attached at one end to a retraction assembly situated within the space or cavity created between a steeply sloping roofline and an interior wall. The collapsible bed frame, when fully collapsed and retracted, allows the bed structure to be completely stowed within the limited space created between said sloping roofline and said interior wall thereby increasing the usable floor space of the room.

An advantage of the present invention is the provision of a collapsible and retractable bed structure which can be incorporated into the wall area of a room with very limited wall and floor space thereby providing additional sleeping facilities in spaces previously unavailable or unusable as living quarters.

Another advantage of the present invention is the provision of a collapsible and retractable bed structure which can be used with A-frame type structures, garage apartments, lofts, structures having cathedral type ceilings, or in any area of a building where the pitch of a roofline restricts or limits wall space, headspace and/or floor space.

A further advantage of the present invention is the provision of a collapsible and retractable bed structure which utilizes the typically wasted space or cavity between a steeply pitched roofline and floor of an interior space.

Another advantage of the present invention is the provision of a collapsible and retractable bed structure the design of which allows the structure to be easily collapsed and folded and which also allows the structure to be stored or stowed within the limited space created by a "knee wall."

Another advantage of the present invention is the provision of a collapsible and retractable bed structure which can be installed within conventional building framing using simple hand tools and involving only minor frame modifications.

A further advantage of the present invention is the provision of a collapsible and retractable bed structure which can be easily and conveniently stowed during periods of non-use rather than take up prime living area.

A further advantage of the present invention resides in the ability, through incorporation and use of the invention, to convert previously unused or uninhabited rooms into bedrooms and/or fully functional living quarters.

The invention is also particularly advantageous in that the incorporation and use of the invention allows additional furniture to be placed in living areas having restricted floor space.

The invention is also particularly advantageous in its ability to turn unusable or wasted space into usable space thereby adding flexibility to any room and increasing or enhancing the value of the home or building.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
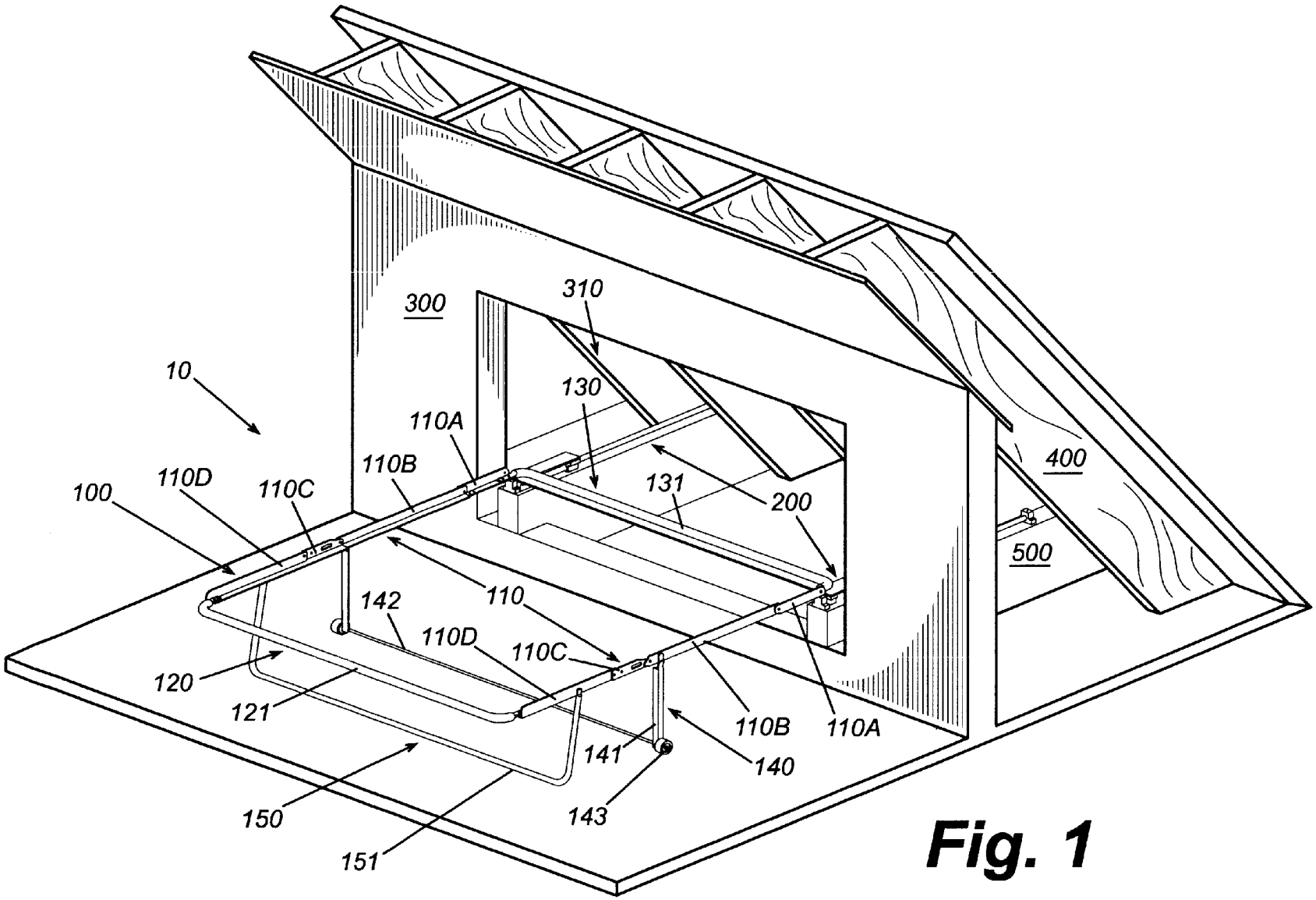
FIG. 1 is a perspective, elevational view of an embodiment of the invention showing the device installed within a typical knee wall in a fully deployed configuration.
Figure 2:
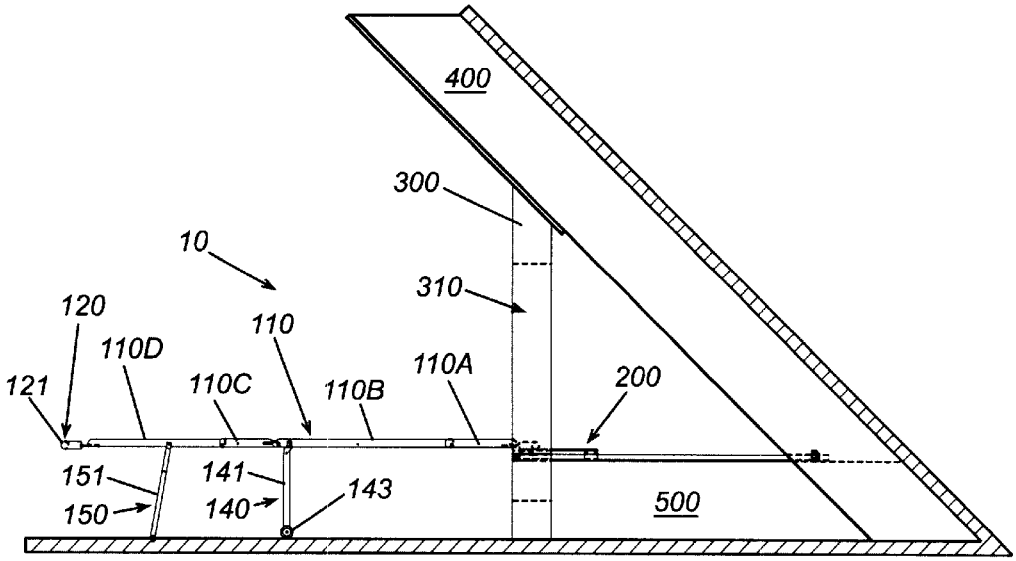
FIG. 2 is a side view of the embodiment of FIG. 1 showing the device in an installed and fully deployed configuration.

In accordance with an embodiment of the invention, FIG. 1 shows a collapsible and retractable bed structure 10 for use in areas of a house or other building structure having limited or restricted floor space. The bed structure 10 of FIG. 1 is shown in an installed configuration and fully extended into the floor space area of a room having an interior "knee" wall 300 and steeply sloping roof rafters 400. The bed structure 10 extends through an opening 310 created in said knee wall 300 and comprises a collapsible bed frame assembly 100 and a bed retraction assembly 200. The design and construction of the bed structure 10 allows the device to be collapsed, retracted and stored, during periods of non-use, within the space created between said knee wall 300 and the roof rafters 400 of the building.

The collapsible bed frame assembly 100 comprises a pair of jointed, generally L-shaped, side rail members 110, a foot-piece member 120, a head-piece member 130, a wheeled center support assembly 140 and a foot support member 150. Each side rail member 110 is comprised of a plurality of pivotally and linearly interconnected L-shaped rail sections 110A–110D. The rail sections 110A–110D of each side rail member 110 have a pair of opposite ends and comprise the following: a first rail section 110A, a second rail section 110B, a third rail section 110C and a fourth rail section 110D. The first rail section 110A of the present embodiment is approximately 10" in length with one end of said first rail section 110A being rigidly attached to one end of the head-piece member 130 of said frame assembly 100. The first rail section 110A forms a perpendicular extension of said head-piece member 130 and is oriented, with respect to said head-piece member 130, so as to be parallel to the floor of the room. The opposing end of said first rail section 110A is joined with one end of the second rail section 110B and provides for the pivotal attachment of said second rail section 110B. The second rail section 110B is approximately 24" in length and is pivotally connected at one end to said first rail section 110A so as to form a linear extension of said first rail section 110A when said second rail section 110B is fully extended to a position parallel to the floor of the room. The opposing end of said second rail section 110B is joined with one end of the third rail section 110C and provides for the pivotal attachment of said third rail section 110C. The third rail section is approximately 9" in length and is pivotally connected at one end to said second rail section 110B so as to form a linear extension of said second rail section 110B when said third rail section 110C is fully extended to a position parallel to the floor of the room. The opposing end of said third rail section 110C is joined with one end of the fourth rail section 110D and provides for the pivotal attachment of said fourth rail section 110D. The fourth rail section 110D is approximately 21" in length and is pivotally connected at one end to said third rail section 110C so as to form a linear extension of said third rail section 110C when said fourth rail section 110D is fully extended to a position parallel to the floor of the room. The opposing end of said fourth rail section 110D is rigidly attached to one end of the foot-piece member 120 of said frame assembly 100.

The foot-piece member 120 of said frame assembly 100 comprises an elongated U-shaped bar 121 which, as previously stated, is rigidly attached at either end to the fourth rail sections 110D of said side rail members 110 thereby completing or closing the lower end of said collapsible bed frame assembly 100 of said bed structure 10.

As with the foot-piece member 120 of said frame assembly 100, the head-piece member 130 comprises an elongated U-shaped bar 131. The head-piece member 130, as previously stated, is rigidly attached at either end to the first rail sections 110A of said side rail members 110 thereby completing or closing the upper end of said collapsible bed frame assembly 100 of said bed structure 10. The head-piece member 130 is also rigidly attached to the bed retraction assembly 200 as discussed below.

The wheeled center support assembly 140 comprises a pair of retractable leg members 141, an axle member 142 and a pair of wheels 143. The leg members 141 are pivotally attached at their upper end to the second rail section 110B of each rail member 110 at or near the midpoint of said rail member 110. In a deployed configuration, the leg members 141 extend perpendicularly from said rail member 110 to a point near the floor of the room and provide vertical support for the frame assembly 100 near the frame assembly 100 midsection. The axle member 142 is attached to, and extends between, said leg members 141 and provides stability to, and lateral support for, said leg members 141. The wheels 143 of said support assembly 140 are rotatably attached to either end of the axle member 142 and function to assist in the deployment and retraction of the bed structure 10.

The foot support member 150 of said frame assembly 100 comprises an elongated U-shaped tube 151 having ends which are pivotally attached to the fourth rail section 110D of each rail member 110 at or near the midpoint of said fourth rail section 110D. In a deployed configuration, the foot support member 150 extends perpendicularly from said fourth rail section 110D to the floor of the room and provides vertical support to the lower or foot portion of the frame assembly 100.

Figure 5:
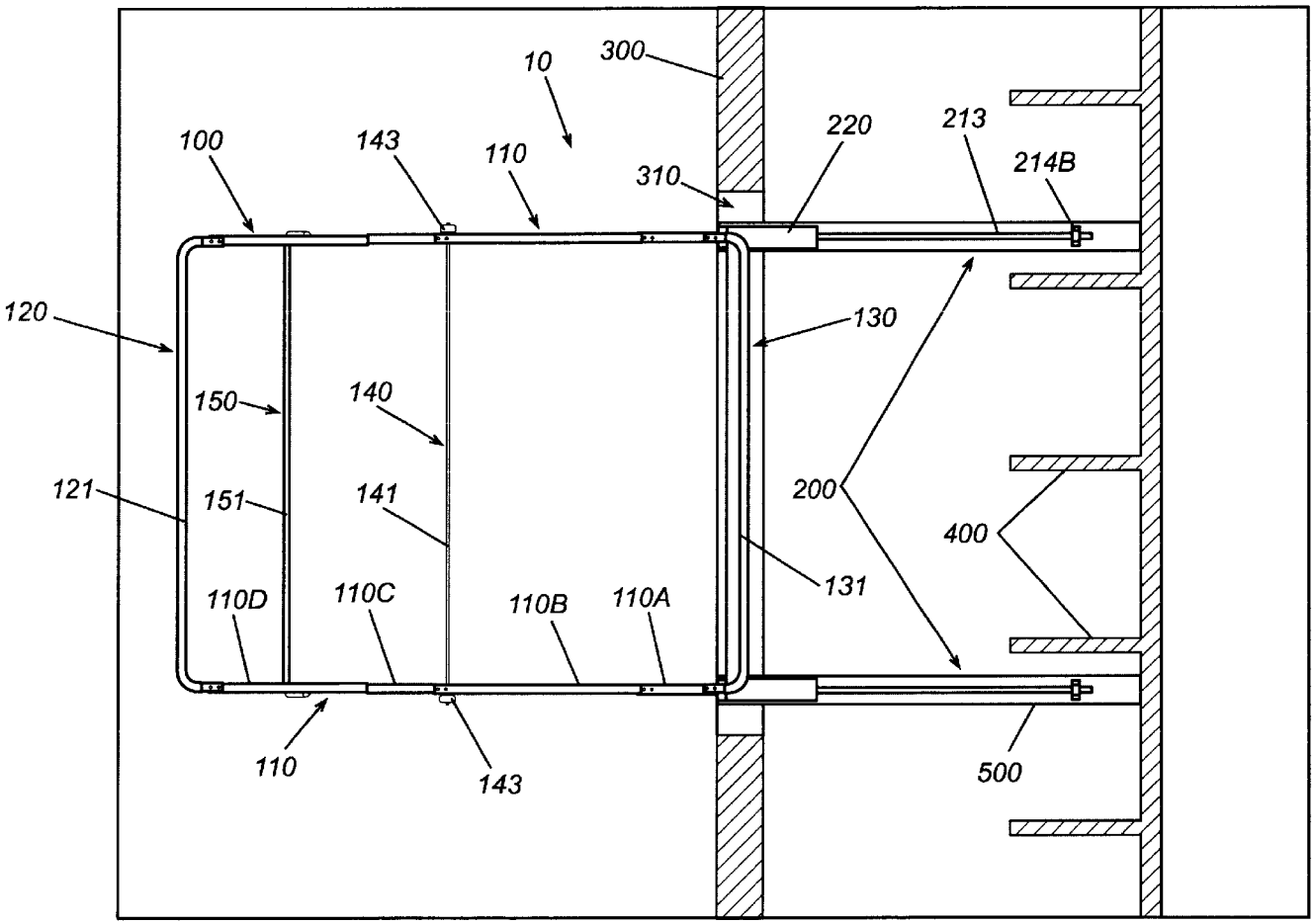
FIG. 5 is a plan view of the invention in a fully deployed configuration shown installed within a typical knee wall space.
Figure 7:
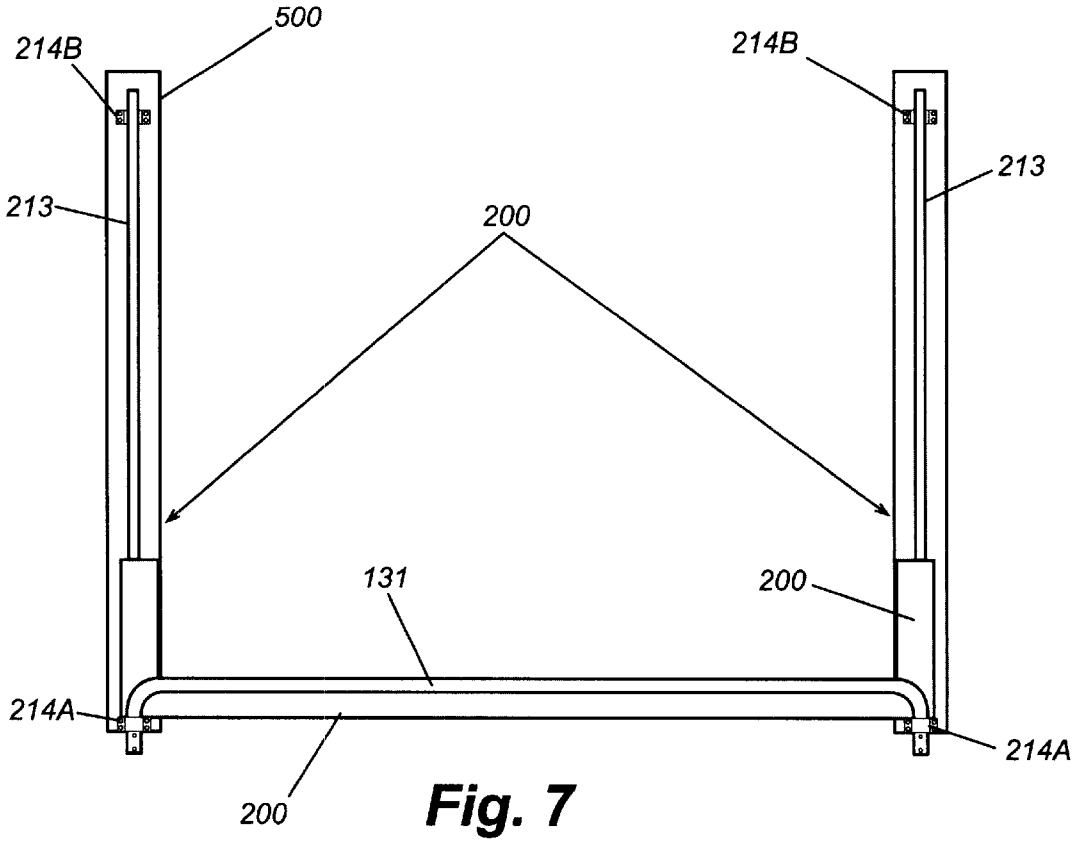
FIG. 7 is a plan view of the embodiment of FIG. 6.
Figure 8:
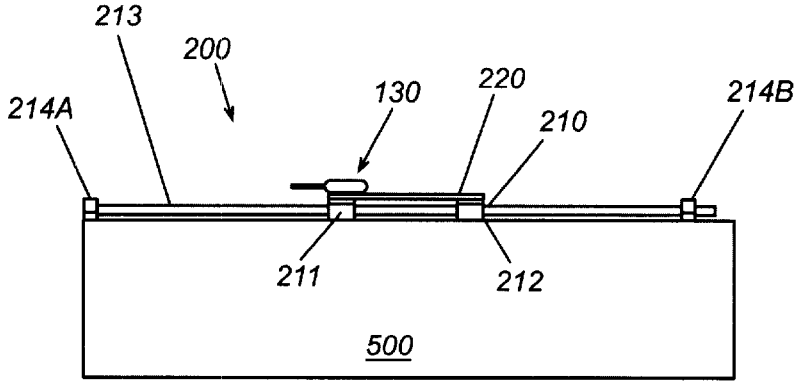
FIG. 8 is a side view of the embodiment of FIG. 6.

The retraction assembly 200, as best seen in the exploded view of FIG. 5, comprises a pair of sliding block assemblies 210 which are laterally and synchronously interconnected by a U-shaped cross beam member 220. Each sliding block assembly 210 comprises a front block member 211, a rear block member 212, a rod member 213 and front and rear mounting blocks 214A & 214B, respectively. The front and rear block members 211 & 212 of each sliding block assembly 210 are spaceably, synchronously and slidably situated along said rod member 213 and have flat upper surfaces 215 for receiving and securing one end of said U-shaped cross beam member 220. The front and rear block members 211 & 212 of each sliding block assembly 210 have been machined or drilled so as to create cylindrical holes 216 through each block 211 & 212 for slidably receiving said rod member 213. The mounting blocks 214A & 214B are attached at either end of each rod member 213 and serve to secure or mount the rod member 213 to a support beam or joist 500 located within the space or cavity created between said interior knee wall 300 and the roof rafters 400 of the building. The rear mounting block 214B of each sliding block assembly may be adjustably positioned along said rod member 213 and said support beam 500 as necessary for proper installation and operation of the retraction assembly 200 . The front and rear mounting blocks 214A & 214B also serve as forward and rearward stops for said retraction assembly 200 when the bed structure 10 is being extended for use or collapsed for storage. Said U-shaped cross beam member 220 is generally flat and extends horizontally between, and synchronously interconnects, the sliding block assemblies 210 of said retraction assembly 200 so that said sliding block assemblies 210 slide or move forward and backward as a single unit during deployment or retraction of the bed structure 10. The head-piece member 130 of the collapsible bed frame assembly 100 is securely attached to the U-shaped cross beam member 220 of said retraction assembly 200 thereby allowing the collapsible bed structure 10 to be slidably retracted into the cavity between the interior knee wall 300 and the building roof rafters 400 for storage during periods of non-use.

Figure 3:
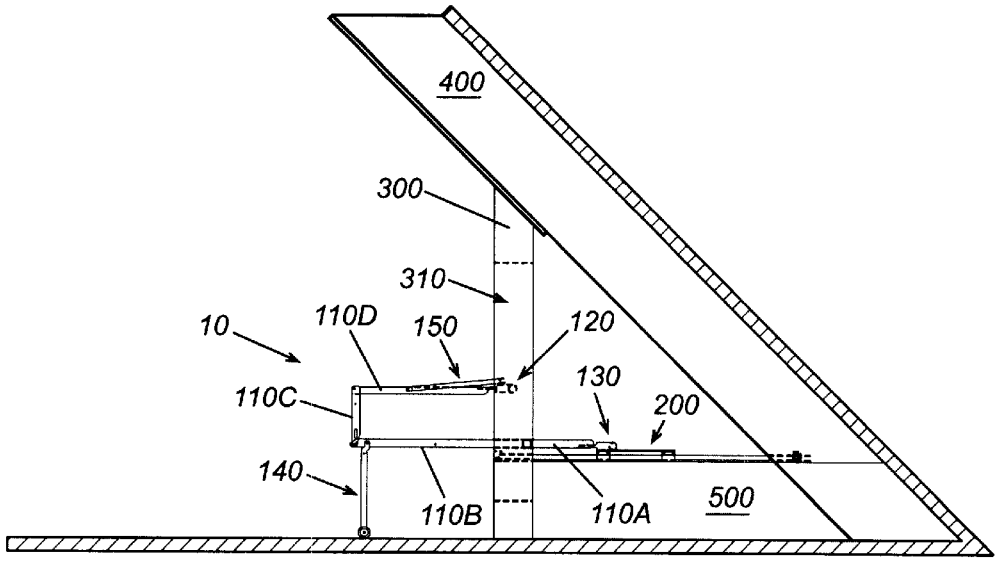
FIG. 3 is a view of the embodiment of FIG. 1 showing the invention in a partially collapsed and partially retracted configuration.
Figure 4:
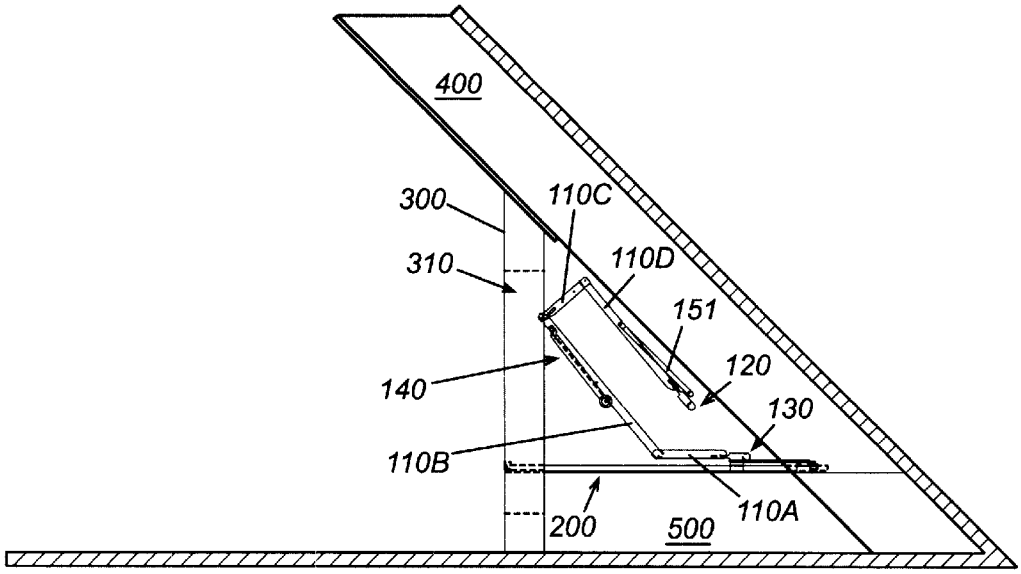
FIG. 4 is a side view of the embodiment of FIG. 1 showing the invention in a fully collapsed, retracted and stored configuration.
Figure 6:
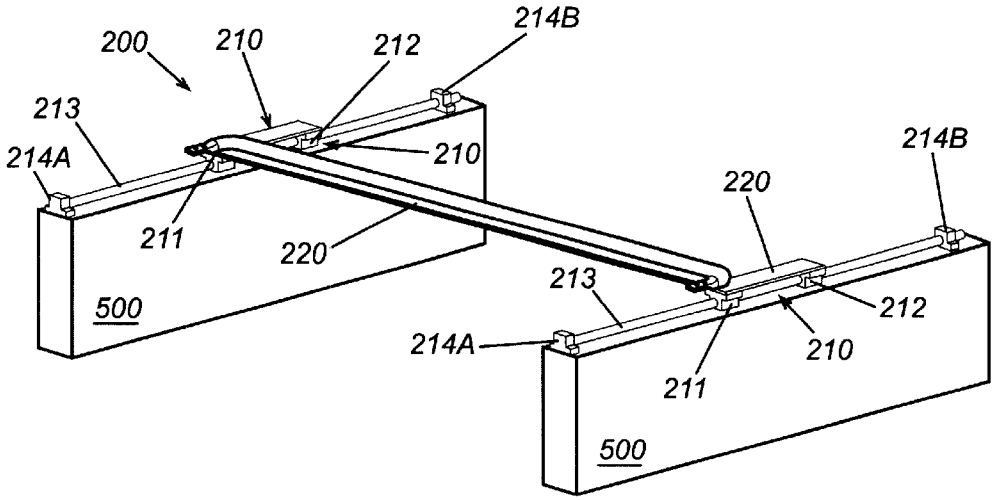
FIG. 6 is an exploded perspective view of the sliding head piece and rail assembly of the invention.

As shown in the sequential drawings of FIGS. 3 and 4, the bed structure 10 of the present embodiment may be collapsed and stored for future use by first pivoting the foot-piece member 120 and fourth rail sections 110D of said frame assembly 100 to a vertical position and by rotating the foot support member 150 to a folded position against said foot-piece member 120 and said fourth rail sections 110D. Next, the third rail sections 110C of said frame assembly 100 are rotated or pivoted into a vertical position. The second rail sections 110B of said frame assembly 100 are then rotated toward vertical to a point determined by the angle between the roof rafters 400 of the building and the floor of the room. The wheeled center support assembly 140 is then rotated into a folded position against the second rail sections 110C of the frame assembly 100. Finally, the entire bed frame assembly 100 is caused to be moved through the knee wall opening 310 into the cavity behind said knee wall 300 for storage by sliding the retraction assembly 200 in a rearward direction until said retraction assembly 200 is stopped by the rear mounting blocks 214B of the sliding block assemblies 210. A privacy door (not shown in the drawings) may also be installed to cover the knee wall opening 310 during periods when the device 10 is not being used and has been retracted and stored within the knee wall space.

The simplicity of the collapsible bed structure 10 of the present invention allows the device 10 to be installed within a typical knee wall of a home or other building using only simple hand tools. Additionally, the device 10 requires only minor wall frame modification for proper installation, operation and use.

The manner of usage and operation of the present invention should be apparent from the above description, therefore, no further discussion relating to the manner of usage and operation has been provided at this time. With respect to the above description, it will be understood that the optimum dimensional relationships for the various parts of the invention will include variations in size, materials, shape, form, function and manner of operation, assembly and use and all equivalent relationships to those illustrated in the drawings and described in the specification are intended to be encompassed by the present. Therefore, while the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A collapsible and retractable bed structure comprising:

a collapsible bed frame assembly comprising:

a pair of side rail members having a first end and a second end;

each of said side rail members comprising a plurality of pivotally interconnected rail sections;

a head rail member attached to the first end of said side rail members and extending between said first ends;

a foot rail member attached to the second end of said side rail members and extending between said second ends;

a center support assembly pivotally attached to said side rail members at or near the midpoint of said side rail members;

a foot support member pivotally attached to said side rail members at or near the foot rail member of said bed frame assembly; and, a retraction means attached to the head rail member of said collapsible bed frame assembly comprising:

a pair of sliding block assemblies with each assembly having a first block member, a second block member, a rod member for slidably receiving said first and second block members, and front and rear mounting blocks for securing the ends of said rod member to a permanent support member such as a structural beam or joist; and, a cross beam member for receiving the head rail member of said frame assembly;

said cross beam member being attached to, and extending between, said pair of sliding block assemblies thereby providing for synchronous movement of said block assemblies whenever said cross beam member is caused to be moved in a linear direction with respect to the rod members of said sliding block assemblies.

2. The apparatus of claim 1, wherein said rail sections of each side rail member comprise a first section, a second section, a third section and a fourth section with each section having a pair of opposite ends, wherein one end of each first rail section is rigidly attached to one end of the head rail member and wherein one end of each fourth rail section is rigidly attached to one end of the foot rail member and wherein the second rail section is pivotally attached to the opposite end of said first rail section and wherein the third rail section is pivotally attached to the opposite end of said fourth rail section and wherein said second and third rail sections are pivotally attached to each other at their opposite ends.

3. The apparatus of claim 1, wherein said pivotally interconnected rail sections of each side rail member have linear dimensions which allow said bed frame assembly to be folded in upon itself for storage.

4. The apparatus of claim 1, wherein said center support assembly provides stability to, and vertical support for, the collapsible bed frame when said frame is in a deployed configuration and comprises a pair of retractable leg members having an upper end and a lower end with each leg member being pivotally attached at its upper end to one of said side rail members, an axle member attached to and extending between said leg members, and a pair of wheels rotatably attached to either end of said axle member.

5. The apparatus of claim 1, wherein said foot support member provides vertical support to the lower or foot portion of the collapsible bed frame assembly when said frame is in a deployed configuration and comprises an elongated U-shaped tube.

6. The apparatus of claim 1, wherein said head and foot rail members comprise elongated U-shaped bars.

7. The apparatus of claim 1, wherein said retraction assembly is mounted to support members located within the area existing between the rafters of a steeply pitched roofline and an interior wall constructed adjacent thereto.

8. The apparatus of claim 1, wherein said cross beam member of said retraction means is generally flat and extends horizontally between said sliding block assemblies and provides synchronous connection between said sliding block assemblies allowing the assemblies to move as a single unit during deployment or retraction of the bed structure.

9. A collapsible and retractable bed structure, comprising:

a collapsible bed frame assembly comprising a pair of jointed, L-shaped, side rail members, a head rail member, a foot rail member, a wheeled center support assembly and a foot support member; and, a bed retraction assembly comprising a pair of sliding block assemblies and a U-shaped cross beam member; wherein each said sliding block assembly of said bed retraction assembly comprises a first block member, a second block member, a rod member for slidably receiving said first and second block members, and front and rear mounting blocks for securing the ends of said rod member to a permanent support member such as a structural beam or joist, and wherein said U-shaped cross beam member of said bed retraction assembly is rigidly attached to the head rail member of said bed frame assembly and extends horizontally between, and synchronously connects, said sliding block assemblies.

* * * * *